US006368464B1

(12) United States Patent
Mausser et al.

(10) Patent No.: US 6,368,464 B1
(45) **Date of Patent: *Apr. 9, 2002**

(54) DEVICE FOR FEEDING A PULP SUSPENSION TO A DEWATERING INSTALLATION

(75) Inventors: Wilhelm Mausser; Manfred Schmid; Walter Writzl, all of Graz; Rudolf Greimel, Graz-Stattegg; Harald Weigant, Graz, all of (AT)

(73) Assignee: Andritz-Patentvenwaltungs-Gesellschaft m.b.H., Graz (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/245,542

(22) Filed: Feb. 5, 1999

(30) Foreign Application Priority Data

Feb. 5, 1998 (AT) ..... A 206/98

(51) Int. Cl.[7] ..... D21F 1/02

(52) U.S. Cl. ..... 162/343; 162/344; 162/345; 162/346; 162/347; 162/336

(58) Field of Search ..... 162/336, 343, 162/344, 345, 346, 347

(56) References Cited

U.S. PATENT DOCUMENTS

| | | | | | |
|---|---|---|---|---|---|
| 4,181,568 | A | * | 1/1980 | Pfaler | 162/343 |
| 4,372,816 | A | * | 2/1983 | Wolf et al. | 162/343 |
| 4,551,204 | A | * | 11/1985 | Holik et al. | 162/336 |
| 4,824,524 | A | * | 4/1989 | Hildebrand | 162/343 |
| 4,891,100 | A | * | 1/1990 | Hildebrand | 162/343 |
| 5,645,689 | A | * | 7/1997 | Ruf et al. | 162/258 |
| 5,849,159 | A | * | 12/1998 | Heinzmann et al. | 162/343 |

* cited by examiner

*Primary Examiner*—Stanley S. Silverman
*Assistant Examiner*—Dionne A. Walls
(74) *Attorney, Agent, or Firm*—Alix, Yale & Ristas, LLP

(57) ABSTRACT

The invention refers to a device for feeding a pulp suspension to a dewatering installation, particularly for a tissue machine. It is mainly characterized by one or several one-piece, wedge-shaped, steel lamella tip(s) being provided to separate the individual sectors in a two-layer or multi-layer headbox.

13 Claims, 4 Drawing Sheets

DEVICE FOR FEEDING A PULP SUSPENSION TO A DEWATERING INSTALLATION

BACKGROUND OF THE INVENTION

The invention relates to a device for feeding a pulp suspension to a dewatering installation, particularly for a tissue machine.

This type of device, also known as a headbox, has a major influence on paper formation and thus, on paper quality. In the headboxes used to date, the pressure provided practically the only means of controlling the flow rate of the pulp suspension. In two-layer and multi-layer headboxes, however, which provide a means of influencing the quality of the paper surface, it is not possible to run the different flow rates needed to obtain, for example, different qualities of top and bottom layer.

SUMMARY OF THE INVENTION

The aim of the invention is thus to improve the field of application for and the means of controlling headboxes.

The invention is thus characterized by one or several one-piece, wedge-shaped, steel lamella tip(s) being provided to separate the individual sectors in a two-layer or multi-layer headbox. In this way it is possible to achieve stable layer separation and thus, a constant setting of the slice gap heights, even at different feed pressures, with the effect that a differential speed can be set between the individual suspension streams.

An advantageous further development of the invention is characterized by the lamella tip(s) being attached under pre-stress by a tie rod to the partition of the feed device. This allows the setting of the slice gap heights to be particularly stable and as a result, precise.

A favorable configuration of the invention is characterized by the spacing of the bottom lip and/or the top lip to the lamella tip being adjustable. In this way, the lamella tip can be securely fixed and made very stable.

An advantageous configuration of the invention is characterized by an eccentric shaft being provided to set the slice gap between a minimum and a maximum height. By setting the height of the slice gap, the flow rate of the suspension stream can easily be adjusted to the needs of the final product. Since an eccentric shaft is used, this guarantees high-precision adjustment of the slice gap.

A favorable further development of the invention is characterized by the top lip being adjustable using an eccentric shaft, where the bottom lip can also be made adjustable with an eccentric shaft either as an alternative or in addition. The facility for setting the top and/or bottom lip, depending on whether the headbox is of two-layer or multi-layer design, permits optimum conditions for regulating the flow rate for the individual layers.

A favorable configuration of the invention is characterized by a partition and lamella tip unit being adjustable by means of an eccentric shaft.

An advantageous configuration of the invention is characterized by the eccentric shaft being supported at several points over the machine width, where these supports can be positioned at regular intervals.

A favorable further development of the invention is characterized by the eccentric shaft being connected to a gear motor. In this way the slice gap and thus, the flow rate of the pulp suspension can also be set or adjusted accordingly while the paper machine is in operation.

BRIEF DESCRIPTION OF THE DRAWINGS

The invention will now be described in examples and referring to the drawings, where.

DETAILED DESCRIPTION OF THE PREFERRED EMBODIMENTS

Figure 1:
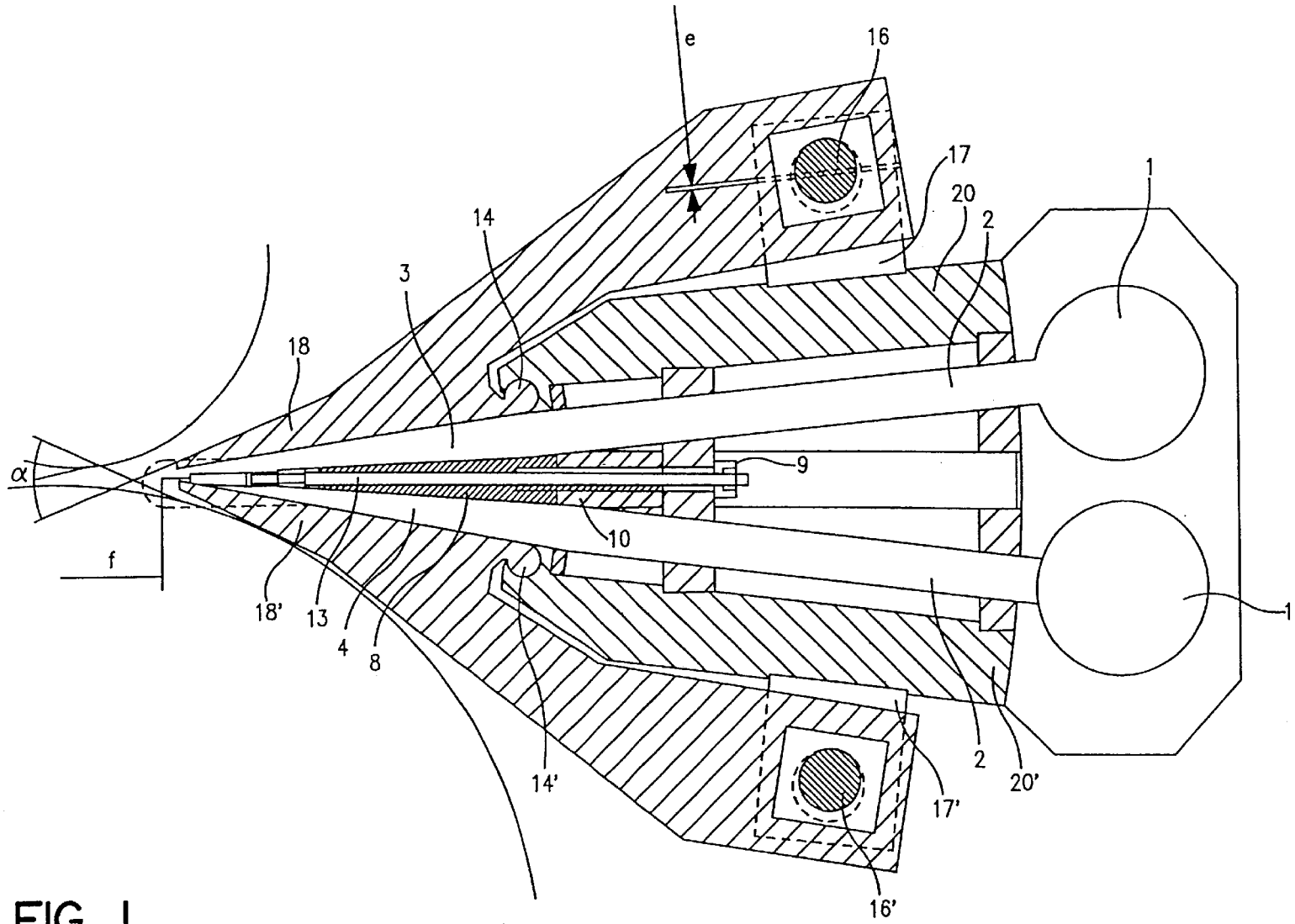
FIG. 1 is a cross-sectional view of a two-layer headbox in accordance with the invention.

FIG. 1 illustrates a device for feeding pulp suspensions to a dewatering installation, particularly for a tissue machine, in the form of a two-layer headbox. Here the suspension is fed in through two channels 1 simultaneously at right angles to the machine direction, then the flow direction of the suspension is turned through 90 degrees into the machine direction. The suspension is then fed through two turbulence chambers 2 into the outlet chambers 3, 4, which are designed as nozzle areas, with the suspension leaving the device at the end of these chambers and entering the dewatering installation. The two nozzle areas 3, 4 are divided by a partition 8 which is attached under pre-stress to the supporting structure 10 by means of hollow screws 9. At the outlet end of the partition 8 there is a one-piece, wedge-shaped lamella tip 12 made of stainless steel, which is attached under pre-stress to the partition 8 by tie rods 13. When assembled, the partition 8 and the lamella tip 12 form a fixed dividing element between the two nozzle areas 3 and 4. Since this element is attached under pre-stress to the supporting structure 10, it is possible to apply different operating pressures (up to 0.5 bar) and thus, different suspension flow speeds for each layer.

In order to do this, the slice gaps a and b of the two nozzles areas 3, 4 must be set at different heights. For this purpose the top lip 18 and the bottom lip 18' are pivoted round the articulated joints 14 and 14'. This pivoting movement is implemented by an eccentric shaft 16, 16', which is supported in bearings 17, 17' on the rigid cover plates 20, 20' of the device at regular intervals over the machine width. Due to the eccentricity e of the shafts, the slice gaps a and b can be set between a minimum and a maximum height.

The structure is designed such that the top lip 18 and the bottom lip 18' never touch the lamella tip 12 and thus no damage can occur, even when the eccentric shaft 16, 16', is rotated continuously by a drive 22.

Due to this adjustment of the top and bottom lip using eccentric shafts 16, 16', the contour angle $\alpha$ at the two-layer headbox is smaller than in conventional adjustments using gear motors. This permits a substantial reduction in the length of the free flow path f of the pulp jet from the headbox outlet until coming into contact with the wires or felts running over the rolls. This then leads to improved stability in the free-flow jet and thus, to an improvement in paper quality.

Due to the rigid lamella tip 12 and the resulting means of providing different suspension flow rates in the two chambers (nozzle areas) 3, 4, there is an improvement in paper quality in the operating mode for "same pulp types" in both chambers and very good separation (covering) of the layers in the operating mode for "different pulp types" in both chambers compared with single-layer and multi-layer headboxes with flexible partition elements at the nozzle area outlets, which do not permit any difference between the two pulp layers.

Figure 4:
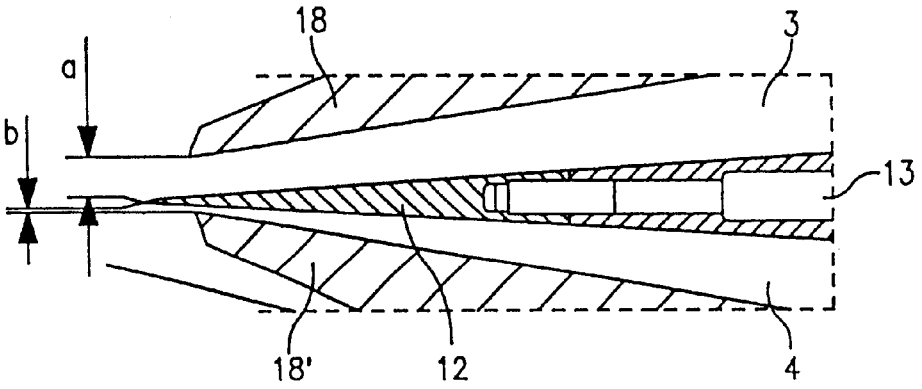
FIG. 4 is an enlarged cross-sectional view of the upper and lower lips, the lamella tip, tie rods and outlet chambers of the headbox of FIG. 1.

FIG. 4 shows a detail of the slice gap in FIG. 1. The difference in size between the slice gaps a (nozzle area 3) and b (nozzle area 4) is clearly shown here.

Figure 2:
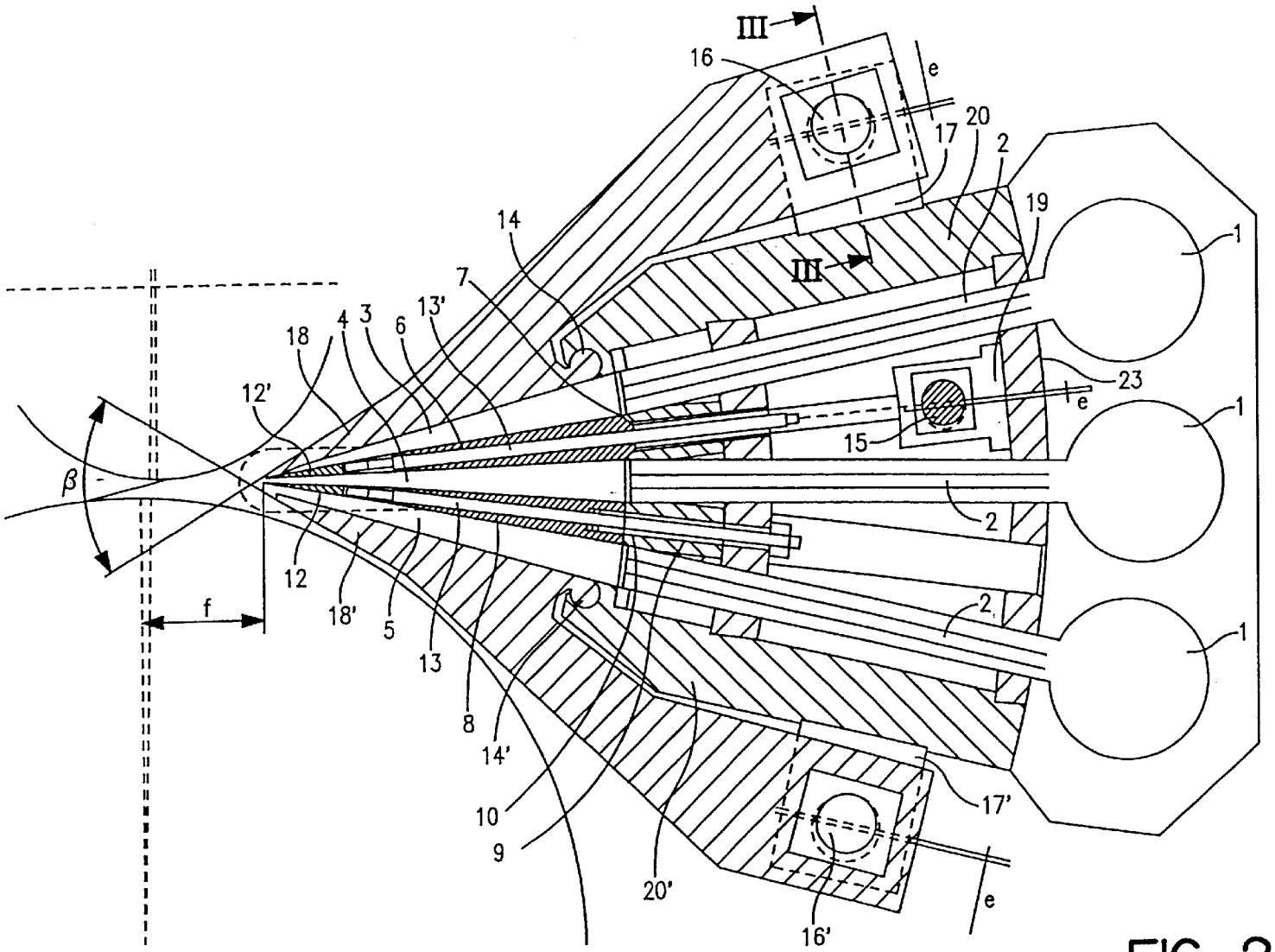
FIG. 2 is a cross-sectional view of a three-layer headbox in accordance with the invention.

FIG. 2 now shows a three-layer headbox, where the suspension is fed into the device through three channels 1 simultaneously at right angles to the machine direction, then the direction of flow is turned through 90 degrees into the machine direction. The suspension then flows through three turbulence chambers 2 into the outlet chambers, known as nozzle areas 3, 4, 5, at the end of which it leaves the device and enters the dewatering machine. Here, the suspension is injected into the gap between two wires which run over two rolls.

The two nozzle areas 4, 5 are separated by a partition 8, the same as the design in FIG. 1. At the end of this partition 8 there is a one-piece, wedge-shaped lamella tip 12 made of stainless steel. When assembled, the partition 8 and the lamella tip 12 form a fixed, non-adjustable dividing element between the two nozzle areas 4, 5. Since this element is attached under pre-stress to the supporting structure 10, it is possible to obtain differences of up to 0.5 bar and thus, different flow rates in the pulp suspension for the two layers.

The two nozzle areas 3, 4 are separated by a partition 6 which pivots round an axis 7. At the outlet end of the partition 6 there is also a one-piece lamella tip 12' made of stainless steel, which is attached under pre-stress to the partition 6 by tie rods 11. The partition 6 and the lamella tip 12' thus form a rigid dividing element which can, however, be pivoted in one piece round the axis 7. This pivoting movement is effected by an eccentric shaft 15, which is supported in bearings 19 on the rigid rear wall 23 of the device at regular intervals over the machine width.

Due to this eccentricity e, the slice gap c of the nozzle area 4 can be set between a minimum and a maximum height and secured at the height selected. The slice gaps a and b of the two nozzle chambers 3 and 5 can also be set and secured between a minimum and a maximum height. In order to do this the top lip 18 and the bottom lip 18' are pivoted round the articulated joints 14, 14'. This pivoting movement is effected by an eccentric shaft 16, 16', supported in bearings 17, 17' on the rigid cover plates 20, 20' of the device at regular intervals over the machine width. The eccentricity e of the shafts 16, 16' allows the slice gaps a and b to be set between a minimum and a maximum height.

The structure is designed such that the top lip 18 and the bottom lip 18' never touch the lamella tip 12, 12', and thus no damage can occur, even when the eccentric shaft 16, 16' is rotated continuously by a drive 22. The same applies for all positions of the adjustable partition 6 with lamella tip 12'.

Due to this adjustment of the top and bottom lip using eccentric shafts 16, 16', the contour angle β at the three-layer headbox is smaller than in conventional adjustments using gear motors. This also permits a substantial reduction in the length of the free flow path f of the pulp jet from the headbox outlet until coming into contact with the wires or felts running over the rolls. This then leads to improved stability in the free-flow jet and thus, to an improvement in paper quality.

As a result, it is also possible to operate the three-layer headbox with different flow speeds for the inner and for the two outer layers.

In addition to the advantages already mentioned for the two-layer headbox, such as paper quality, covering and separation of layers, a further advantage with a three-layer headbox is that poorer quality pulp can be used for the middle layer without this having a detrimental effect on the quality of the paper.

Figure 5:
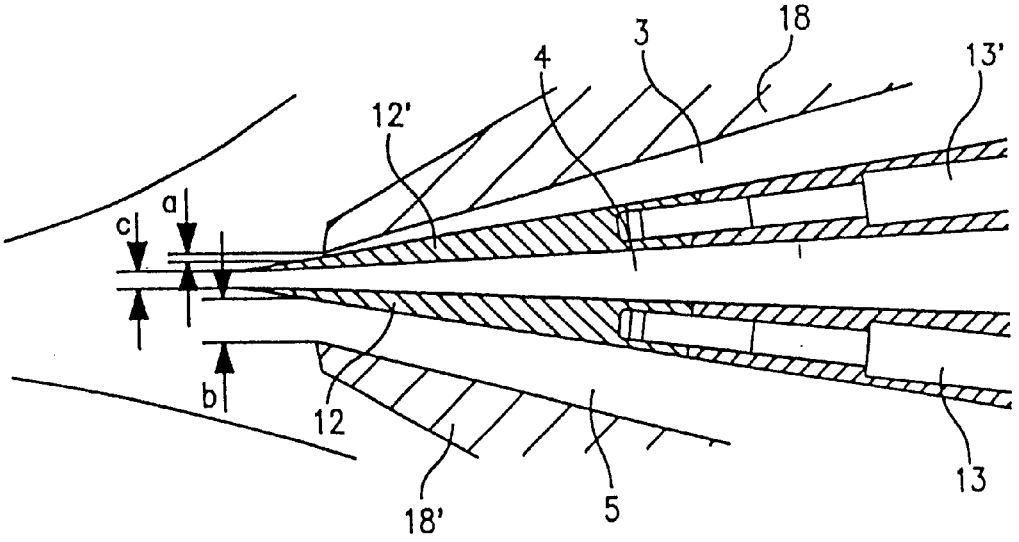
FIG. 5 is an enlarged cross-sectional view of the upper and lower lips, the lamella tips, tie rods and outlet chambers of the headbox of FIG. 2.

FIG. 5 shows a detail of the slice gap illustrated in FIG. 2. Here we can see different settings of slice gap heights a (nozzle area 3), b (nozzle area 5), and c (nozzle area 4).

Figure 3:
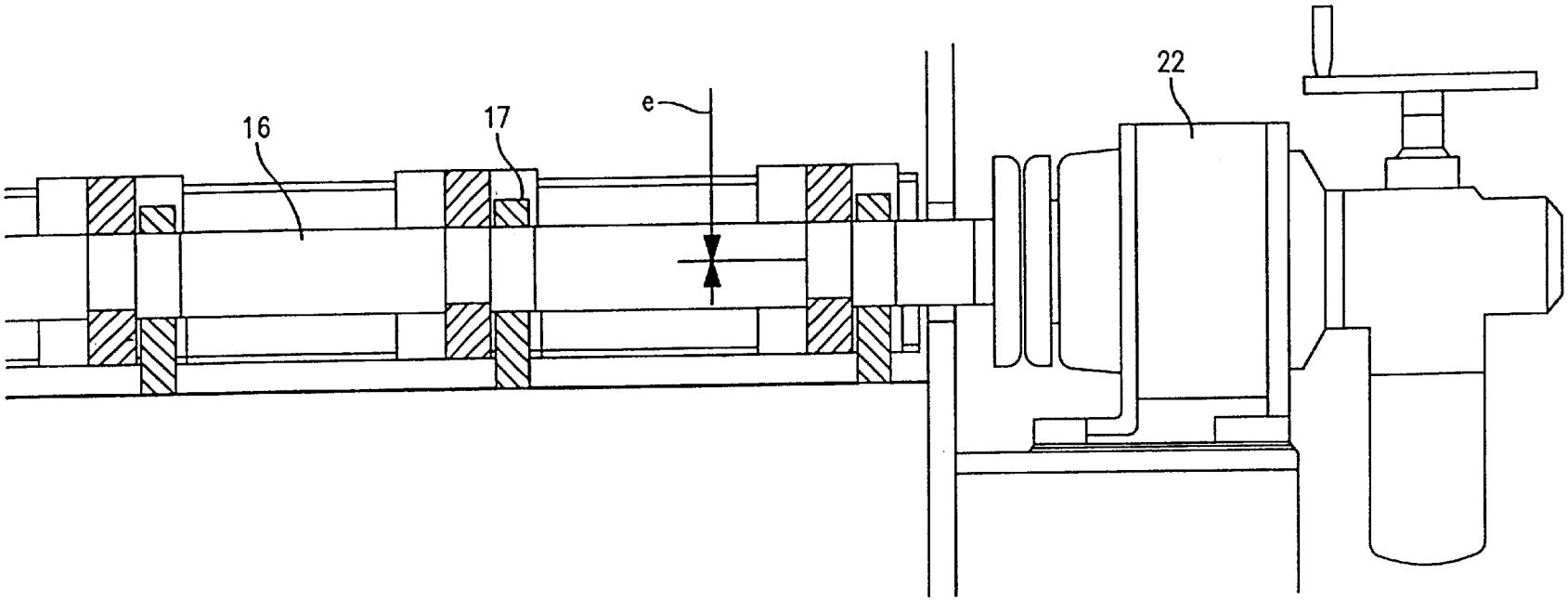
FIG. 3 is cross-sectional view along the line III—III of FIG. 2.

FIG. 3 shows a section through the line marked III—III in FIG. 1 and also in FIG. 2. The eccentric shaft 16 is shown here, supported in bearings 17 at several points over the machine width. A gear motor 22 is also shown for setting the height of the slice gap.

The invention is not limited to the examples described. Other forms of lip adjustment device can also be provided.

What is claimed is:

1. Device for feeding a pulp suspension to a tissue machine having a multi-layer headbox including at least one partition separating a pair of adjacent sectors, the device comprising at least one, one-piece, wedge-shaped, fixed steel lamella tip for separating the sectors of the headbox, and at least one tie rod, wherein the lamella tip is attached under pre-stress to the partition by a single tie rod, the partition and attached lamella tip form a fixed dividing element and the lamella tip and the adjacent sectors define first and second predefined slice gaps.

2. Device according to claim 1 further comprising top and bottom lips, the top lip and the lamella tip defining the first slice gap and the bottom lip and the lamella tip defining the second slice gap, wherein the slice gap between the bottom lip or the top lip and the lamella tip is adjustable.

3. Device according to claim 2 further comprising a plurality of eccentric shafts, an eccentic shaft being engaged with each of the top and bottom lips for setting the slice gap between a minimum and a maximum height.

4. Device according to claim 3 wherein the device has a machine width and the eccentric shaft is supported at several points over the machine width.

5. Device according to claim 3 further comprising a gear motor connected to the eccentric shaft.

6. Device according to claim 1 further comprising a top lip and an eccentric shaft engaged with the top lip, the top lip being adjustable by the eccentric shaft.

7. Device according to claim 1 further comprising a bottom lip and an eccentric shaft engaged with the bottom lip, the bottom lip being adjustable by the eccentric shaft.

8. Device according to claim 1 further comprising an eccentric shaft engaged with one of the partitions, the partition and lamella tip being adjustable by the eccentric shaft.

9. Device according to claim 8 wherein the device has a machine width and the eccentric shaft is supported at several points over the machine width.

10. Device according to claim 9 wherein the eccentric shaft is supported at regular intervals.

11. Device according to claim 8 further comprising a gear motor connected to the eccentric shaft.

12. Device according to claim 1 further comprising top and bottom lips, the top lip and the lamella tip defining the first slice gap and the bottom lip and the lamella tip defining the second slice gap, wherein the first and second slice gaps are adjustable.

13. Device for feeding a pulp suspension to a tissue machine having a multi-layer headbox including at least one partition separating a pair of adjacent sectors, the device comprising at least one, one-piece, wedge-shaped, rigid lamella tip, for separating the sectors of the headbox, and at least one tie rod, wherein the lamella tip and the adjacent sectors define first and second predefined slice gaps and the lamella tip is fixedly attached under pre-stress by a single tie rod to the partition of the feed device.

* * * * *